US012690690B2

(12) United States Patent
Choi

(10) Patent No.: US 12,690,690 B2
(45) Date of Patent: Jul. 28, 2026

(54) FOLDABLE AND ADJUSTABLE FRAME

(71) Applicant: Inno-Sports Co., Ltd., Xiamen (CN)

(72) Inventor: Kwan Jun Choi, Xiamen (CN)

(73) Assignee: Inno-Sports Co., Ltd., Xiamen (CN)

( * ) Notice: Subject to any disclaimer, the term of this patent is extended or adjusted under 35 U.S.C. 154(b) by 160 days.

(21) Appl. No.: 18/498,552

(22) Filed: Oct. 31, 2023

(65) Prior Publication Data

US 2024/0382008 A1 Nov. 21, 2024

(30) Foreign Application Priority Data

May 17, 2023 (CN) ..... 202321195383.3

(51) Int. Cl.
*A47C 19/12* (2006.01)
*A47C 19/04* (2006.01)

(52) U.S. Cl.
CPC ..... *A47C 19/126* (2013.01); *A47C 19/04* (2013.01)

(58) Field of Classification Search
CPC ..... A47C 19/126; A47C 19/04; A47C 19/12
USPC ..... 5/175, 177, 179
See application file for complete search history.

(56) References Cited

U.S. PATENT DOCUMENTS 5,987,673 A * 11/1999 Smith ..... A61G 1/0262 280/655
10,912,390 B1 * 2/2021 Chung ..... A47C 19/04
11,006,763 B1 * 5/2021 Oh ..... A47C 19/021
2010/0235989 A1 * 9/2010 Jin ..... A47C 19/126 5/174
2012/0246826 A1 * 10/2012 Jin ..... A47C 19/124 5/400
2020/0359803 A1 * 11/2020 Choi ..... F16B 12/54
2021/0045538 A1 * 2/2021 Leng ..... A47C 19/126

* cited by examiner

*Primary Examiner* — Justin C Mikowski
*Assistant Examiner* — George Samuel Gines
(74) *Attorney, Agent, or Firm* — MORGAN, LEWIS & BOCKIUS LLP

(57) ABSTRACT

A frame includes a middle unit, a first unit and a second unit. Each of the middle, first and second units includes pivotally connected longitudinal members. Each of the first and second units also includes lateral members pivotally connected to its longitudinal members and the middle unit. The lateral and longitudinal members of the middle, first and second units are foldable onto each other, making the frame very compact when folded. The lateral members of at least one of the first and second units are adjustable in length, allowing the frame to adjust its dimension in a lateral direction when unfolded. Additionally or optionally, at least one longitudinal member of the first unit and at least one longitudinal member of the second unit are adjustable in length, allowing the frame to adjust its dimension in a longitudinal direction when unfolded.

20 Claims, 13 Drawing Sheets

FOLDABLE AND ADJUSTABLE FRAME

CROSS-REFERENCE TO RELATED APPLICATIONS

The present application claims priority to Chinese Application CN 202321195383.3 filed May 17, 2023. The disclosure of the application is incorporated herein for all purposes by reference in its entirety.

FIELD OF THE INVENTION

The present invention generally relates to frames, in particular, to foldable and adjustable frames.

BACKGROUND

Foldable beds are widely used in homes, offices and other places. However, many existing foldable beds have fixed dimensions when unfolded and cannot be adjusted to meet different needs of different users. Moreover, many existing foldable beds are still large in size when folded. They are cumbersome and require more storage space. Further, many existing foldable bed frames cannot be folded and unfolded in one piece. Some parts have to be dissembled or assembled in order to fold or unfold such frames.

Given the current state of the art, there remains a need for frames and beds that address the abovementioned issues.

The information disclosed in this Background section is provided for an understanding of the general background of the invention and is not an acknowledgement or suggestion that this information forms part of the prior art already known to a person skilled in the art.

SUMMARY OF THE INVENTION

The present disclosure provides frames that can be folded and unfolded as a whole with no need to assemble or dissemble any parts and when unfolded their sizes can be adjusted to meet different needs of users.

In various exemplary embodiments, the present disclosure provides a frame including a middle unit, a first unit and a second unit, with the first unit disposed at a first side of the middle unit and a second unit disposed at a second side of the middle unit when the frame is unfolded. The middle unit includes a first supporting member, a second supporting member, a first coupler and a second coupler. Proximal ends of the first and second supporting members are pivotally connected to each other. A distal end of the first supporting member is pivotally connected to the first coupler such that the first supporting member is rotatable relative to the first coupler around a first lateral axis. A distal end of the second supporting member is pivotally connected to the second coupler such that the second supporting member is rotatable relative to the second coupler around a second lateral axis. The first unit includes a first longitudinal member, a second longitudinal member, a first lateral member and a second lateral member. Proximal ends of the first and second longitudinal members are pivotally connected to each other. A distal end of the first lateral member is pivotally connected to the first longitudinal member. A distal end of the second lateral member is pivotally connected to the second longitudinal member. A proximal end of the first lateral member is pivotally connected to the first coupler and a proximal end of the second lateral member is pivotally connected to the second coupler such that the first unit is rotatable relative to the first and second couplers around a first longitudinal axis.

The second unit includes a third longitudinal member, a fourth longitudinal member, a third lateral member and a fourth lateral member. Proximal ends of the third and fourth longitudinal members are pivotally connected to each other. A distal end of the third lateral member is pivotally connected to the third longitudinal member. A distal end of the fourth lateral member is pivotally connected to the fourth longitudinal member. A proximal end of the third lateral member is pivotally connected to the first coupler and a proximal end of the fourth lateral member is pivotally connected to the second coupler such that the second unit is rotatable relative to the first and second couplers around a second longitudinal axis. In such embodiments, the first and second supporting members of the middle unit, the first and second longitudinal members of the first unit, the first and second lateral members of the first unit, the third and fourth longitudinal members of the second unit, and the third and fourth lateral members of the second unit are foldable onto each other. In addition, each of the first and second lateral members of the first unit is adjustable in length, thereby allowing the frame when unfolded to adjust its size in a lateral direction of the frame.

In some exemplary embodiments, each of the first and second couplers includes a first slot, a second slot and a third slot. The first slot receives or pivotally connects the distal end of the first or second supporting member of the middle unit. The second slot receives or pivotally connects the distal end of the first or second lateral member of the first unit. The third slot receives or pivotally connects the distal end of the third or fourth lateral member of the second unit.

In some exemplary embodiments, the second and third slots are aligned with each other, and the first slot is substantially perpendicular to the second and third slots.

In some exemplary embodiments, the first lateral axis is located outwardly relative to the first lateral member of the first unit and the third lateral member of the second unit. The second lateral axis is located outwardly relative to the second lateral member of the first unit and the fourth lateral member of the second unit.

In some exemplary embodiments, the first and second units are substantially the same.

In some exemplary embodiments, each of the third and fourth lateral members of the second unit is adjustable in length.

In some exemplary embodiments, each of the first and second lateral members of the first unit includes a plurality of segments telescopically coupled with each other.

In some exemplary embodiments, the plurality of segments includes a first segment and a second segment. The first segment is pivotally connected to the first or second longitudinal member of the first unit. The second segment is pivotally connected to the first or second coupler. The first and second segments are coupled with each other and movable relative to each other along a length direction of the first or second lateral member of the first unit.

In some exemplary embodiments, the plurality of segments further includes a third segment disposed between the first and second segments. The third segment is slidably coupled with the first segment and the second segment is slidably coupled with the third segment. The first, second and third segments are movable relative to each other along the length direction of the first or second lateral member of the first unit.

In some exemplary embodiments, at least a portion of each of the first, second and third segments is tubular such that the first segment receives at least a portion of the third segment and the third segment receives at least a portion of the second segment. In addition, the first segment includes a plurality of first snap-in holes spaced apart from each other along a length direction of the first segment. The third segment includes a first snapping part and a plurality of second snap-in holes spaced apart from each other along a length direction of the third segment. The second segment includes a second snapping part. The first snapping part of the third segment is selectively engageable with any one of the plurality of first snap-in holes of the first segment, and the second snapping part of the second segment is selectively engageable with any one of the plurality of second snap-in holes of the third segment, thereby allowing the frame when unfolded to adjust its size.

In some exemplary embodiments, the first snapping part includes a first elastic member disposed inside of the third segment and a first protrusion biased by the first elastic member to protrude through a hole on a wall of the third segment. The second snapping part includes a second elastic member disposed inside of the second segment and a second protrusion biased by the second elastic member to protrude through a hole on a wall of the second segment.

In some exemplary embodiments, the proximal ends of the first and second supporting members of the middle unit are pivotally connected to each other by a third coupler such that the first supporting member is rotatable relative to the third coupler around a third lateral axis, and the second supporting member is rotatable relative to the third coupler around a fourth lateral axis.

In some exemplary embodiments, the proximal ends of the first and second longitudinal members are pivotally connected to each other by a fourth coupler such that the first longitudinal member is rotatable relative to the fourth coupler around a first auxiliary axis, and the second longitudinal member is rotatable relative to the fourth coupler around a second auxiliary axis. The distal end of the first lateral member is pivotally connected to the first longitudinal member such that the first longitudinal member is rotatable relative to the first lateral member around a third auxiliary axis. The distal end of the second lateral member is pivotally connected to the second longitudinal member such that the second longitudinal member is rotatable relative to the second lateral member around a fourth auxiliary axis. The proximal ends of the third and fourth longitudinal members are pivotally connected to each other by a fifth coupler such that the third longitudinal member is rotatable relative to the fifth coupler around a fifth auxiliary axis, and the fourth longitudinal member is rotatable relative to the fifth coupler around a six auxiliary axis. The distal end of the third lateral member is pivotally connected to the third longitudinal member such that the third longitudinal member is rotatable relative to the third lateral member around a seventh auxiliary axis. The distal end of the four lateral member is pivotally connected to the fourth longitudinal member such that the fourth longitudinal member is rotatable relative to the fourth lateral member around an eighth auxiliary axis. When the frame is unfolded, the first, second, third, fourth, fifth, sixth, seventh and eighth auxiliary axes are substantially vertical.

In some exemplary embodiments, when the first and second units are folded onto each other by rotating the first unit around the first longitudinal axis and rotating the second unit around the second longitudinal axis, the first, second, third, fourth, fifth, sixth, seventh and eighth auxiliary axes are substantially parallel to the first, second, third and fourth lateral axes.

In some exemplary embodiments, when the first and second units are folded onto each other by rotating the first unit around the first longitudinal axis and rotating the second unit around the second longitudinal axis, the first and fifth auxiliary axes are aligned with each other, the second and sixth auxiliary axes are aligned with each other, the third and seventh auxiliary axes are aligned with each other, and the fourth and eighth auxiliary axes are aligned with each other.

In some exemplary embodiments, a distance between the first and second auxiliary axes or between the fifth and sixth auxiliary axes is greater than a distance between the third and fourth lateral axes.

In some exemplary embodiments, the middle unit further includes a first middle leg fixedly connected to the first coupler, a second middle leg fixedly connected to the second coupler, and a third middle leg fixedly connected to the third coupler.

In some exemplary embodiments, the first unit further includes a first plurality of legs, each pivotally connected to the first or second longitudinal member. The second unit further includes a second plurality of legs, each pivotally connected to the third or fourth longitudinal member.

In some exemplary embodiments, each of the first longitudinal member of the first unit and the third longitudinal member of the second unit is adjustable in length, thereby allowing the frame when unfolded to adjust its size in a longitudinal direction of the frame.

In various exemplary embodiments, the present disclosure provides a frame including a middle unit, a first unit disposed at a first side of the middle unit and a second unit disposed at a second side of the middle unit when the frame is unfolded. The first unit includes a first longitudinal support and a pair of first lateral supports, each first lateral support having an end connected to the middle unit and another end connected to the first longitudinal support. The second unit includes a second longitudinal support and a pair of second lateral supports, each second lateral support having an end connected to the middle unit and another end connected to the second longitudinal support. In addition, the first longitudinal support of the first unit and the second longitudinal support of the second unit are adjustable in length, thereby allowing the frame to adjust its size in a longitudinal direction of the frame, and the pair of first lateral supports or the pair of second lateral supports is adjustable in length, thereby allowing the frame to adjust its size in a lateral direction of the frame.

The foldable frames and beds of the present disclosure have other features and advantages that will be apparent from, or are set forth in more detail in, the accompanying drawings, which are incorporated herein, and the following Detailed Description, which together serve to explain certain principles of exemplary embodiments of the present disclosure.

BRIEF DESCRIPTION OF THE DRAWINGS

The accompanying drawings, which are incorporated into and constitute a part of this specification, illustrate one or more exemplary embodiments of the present disclosure and, together with the Detailed Description, serve to explain the principles and implementations of exemplary embodiments of the invention.

Figure 1A:
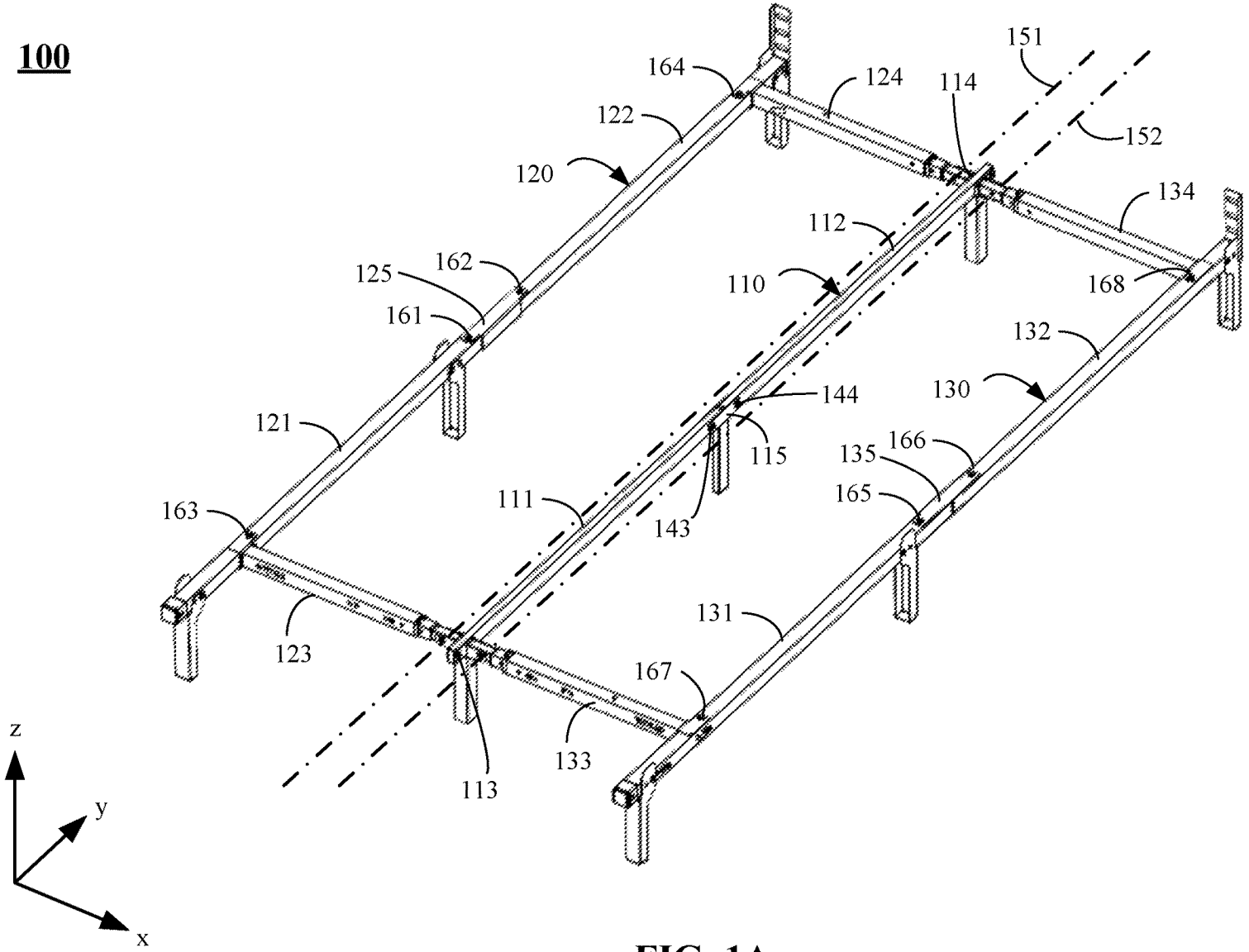
FIG. 1A is a top perspective view schematically illustrating an exemplary frame in an unfolded state and a first size in accordance with some exemplary embodiments of the present disclosure.

As will be apparent to those of skill in the art, the components illustrated in the figures described above are combinable in any useful number and combination. The figures are intended to be illustrative in nature and are not limiting.

DETAILED DESCRIPTION

Reference will now be made in detail to implementation of exemplary embodiments of the present disclosure as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present disclosure will readily suggest themselves to such skilled persons having benefit of this disclosure.

In the interest of clarity, not all of the routine features of the implementations described herein are shown and described. It will be appreciated that, in the development of any such actual implementation, numerous implementation-specific decisions are made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the exemplary embodiments set forth in this disclosure can be made without departing from the spirit and scope of the exemplary embodiments, as will be apparent to those skilled in the art. The specific exemplary embodiments described herein are offered by way of example only, and the disclosure is to be limited only by the terms of the appended claims, along with the full scope of equivalents to which such claims are entitled.

Embodiments of the present invention are described in the context of foldable and adjustable frames. A foldable and adjustable frame generally includes a middle unit, a first unit and a second unit. Both of the first and second units are pivotally connected to the middle unit while each of the middle, first and second units includes pivotally connected members (e.g., bars). As such, the frame can be folded and unfolded as a whole without dissembling any parts. Moreover, at least one of the first and second units includes one or more adjustable members that allow the frame to adjust its size (e.g., the length or width) when unfolded to meet the needs or preferences of end users. The frames can be used for beds or the like.

In some exemplary embodiments, the middle unit includes pivotally connected longitudinal members, and each of the first and second units includes pivotally connected lateral and longitudinal members. The lateral members of each of the first and second units are also pivotally connected to the middle unit. The lateral and longitudinal members of the middle, first and second units can be folded onto each other. When folded, the frame is compact, requires less storage space, and is easy to transport. The lateral members of at least one of the first and second units are adjustable in length. In some exemplary embodiments, additionally or optionally, at least one longitudinal member of the first unit and at least one longitudinal member of the second unit are adjustable in length. As such, when unfolded, the frame can be adjusted to different sizes, including but not limited to a twin size, a full size, a queen size, a king size or a California king size, to meet different needs or preferences of different users.

Referring now to FIGS. 1A-8, there is depicted an exemplary frame 100 in accordance with some exemplary embodiments of the present disclosure. Frame 100 includes middle unit 110, first unit 120 and second unit 130. The first and second units are connected to the middle unit. When unfolded, the first unit is disposed at a first side of the middle unit (e.g., the left side of the middle unit in FIG. 1) and the second unit is disposed at a second side of the middle unit (e.g., the right side of the middle unit in FIG. 1). The first and second units can be, but do not necessarily have to be, identical or symmetric to each other. Consequently, the middle unit can be, but do not necessarily have to be, at the center of the frame. As a non-limiting example, the first and second units are illustrated to be substantially identical and symmetric to each other.

In some exemplary embodiments, middle unit 110 includes first supporting member 111, second supporting member 112, first coupler 113 and second coupler 114. The first and second supporting members can be, but do not necessarily have to be, identical or symmetric to each other. In some exemplary embodiments, the first and second supporting members of the middle unit have substantially the same length so that the frame can be folded in half along the length direction of the middle unit. As a non-limiting example, the first and second supporting members of the middle unit are illustrated to be substantially identical and symmetric to each other. Similarly, the first and second couplers can be, but do not necessarily have to be, identical or symmetric to each other. As a non-limiting example, the first and second couplers of the middle unit are illustrated to be substantially identical and symmetric to each other.

The distal end of the first supporting member is pivotally connected to the first coupler and the distal end of the second supporting member is pivotally connected to the second coupler. In some exemplary embodiments, the distal end of the first supporting member is pivotally connected to the first coupler such that the first supporting member is rotatable relative to the first coupler around first lateral axis 141. The distal end of the second supporting member is pivotally connected to the second coupler such that the second supporting member is rotatable relative to the second coupler around second lateral axis 142. As used herein, the term "lateral" refers to the x-direction in FIG. 1, which can be, but do not necessarily have to be the width direction of the frame. Similarly, the term "longitudinal" refers to the y-direction in FIG. 1, which can be, but do not necessarily have to be the length direction of the frame.

Proximal ends of the first and second supporting members are pivotally connected to each other. In some exemplary embodiments, proximal ends of the first and second supporting members are pivotally connected to each other by third coupler 115 such that the first supporting member is rotatable relative to the third coupler around third lateral axis 143 and the second supporting member is rotatable relative to the third coupler around fourth lateral axis 144.

In some exemplary embodiments, first unit 120 includes first longitudinal member 121, second longitudinal member 122, first lateral member 123 and second lateral member 124. The first and second longitudinal members can be, but do not necessarily have to be, identical or symmetric to each other. For instance, the first and second longitudinal members can have different lengths and/or different shapes. Similarly, the first and second lateral members can be, but do not necessarily have to be, identical or symmetric to each other. Preferably, the first and second lateral members have substantially the same configuration to enable easy adjustment of the size of the frame when unfolded.

The first and second longitudinal members are pivotally connected to each other at their proximal ends. For instance, in some exemplary embodiments, the proximal ends of the first and second longitudinal members of first unit 120 are pivotally connected to each other by fourth coupler 125 such that the first longitudinal member is rotatable relative to the fourth coupler around first auxiliary axis 161 and the second longitudinal member is rotatable relative to the fourth coupler around second auxiliary axis 162. The pivotally connected first and second longitudinal members are collectively referred to as the first longitudinal support of the first unit.

The first lateral member has a proximal end pivotally connected to the first coupler of the middle unit and a distal end pivotally connected to the first longitudinal member. The second lateral member has a proximal end pivotally connected to the second coupler of the middle unit and a distal end pivotally connected to the second longitudinal member. In some exemplary embodiments, the proximal end of the first lateral member is pivotally connected to the first coupler and the proximal end of the second lateral member is pivotally connected to the second coupler such that the first unit is rotatable relative to the first and second couplers around first longitudinal axis 151. The distal end of the first lateral member of first unit 120 is pivotally connected to the first longitudinal member such that the first longitudinal member is rotatable relative to the first lateral member around third auxiliary axis 163. The distal end of the second lateral member of first unit 120 is pivotally connected to the second longitudinal member such that the second longitudinal member is rotatable relative to the second lateral member around fourth auxiliary axis 164.

In some exemplary embodiments, second unit 130 includes third longitudinal member 131, fourth longitudinal member 132, third lateral member 133 and fourth lateral member 134. The third and fourth longitudinal members can be, but do not necessarily have to be, identical or symmetric to each other. For instance, the third and fourth longitudinal members can have different lengths and/or different shapes. Similarly, the third and fourth lateral members can be, but do not necessarily have to be, identical or symmetric to each other. Preferably, the third and fourth lateral members have substantially the same configuration to enable easy adjustment of the size of the frame when unfolded.

The third and fourth longitudinal members are pivotally connected to each other at their proximal ends. For instance, in some exemplary embodiments, the proximal ends of the third and fourth longitudinal members of second unit 130 are pivotally connected to each other by fifth coupler 135 such that the third longitudinal member is rotatable relative to the fifth coupler around fifth auxiliary axis 165, and the fourth longitudinal member is rotatable relative to the fifth coupler around six auxiliary axis 166. The pivotally connected third and fourth longitudinal members are collectively referred to as the second longitudinal support of the second unit.

The third lateral member has a proximal end pivotally connected to the first coupler of the middle unit and a distal end pivotally connected to the third longitudinal member. The second lateral member has a proximal end pivotally connected to the second coupler of the middle unit and a distal end pivotally connected to the fourth longitudinal member. In some exemplary embodiments, the proximal end of the third lateral member is pivotally connected to the first coupler and the proximal end of the fourth lateral member is pivotally connected to the second coupler so that the second unit is rotatable relative to the first and second couplers around second longitudinal axis 152. The distal end of the third lateral member of second unit 130 is pivotally connected to the third longitudinal member such that the third longitudinal member is rotatable relative to the third lateral member around seventh auxiliary axis 167. The distal end of the four lateral member of second unit 130 is pivotally connected to the fourth longitudinal member such that the fourth longitudinal member is rotatable relative to the fourth lateral member around eighth auxiliary axis 168.

Figure 5:
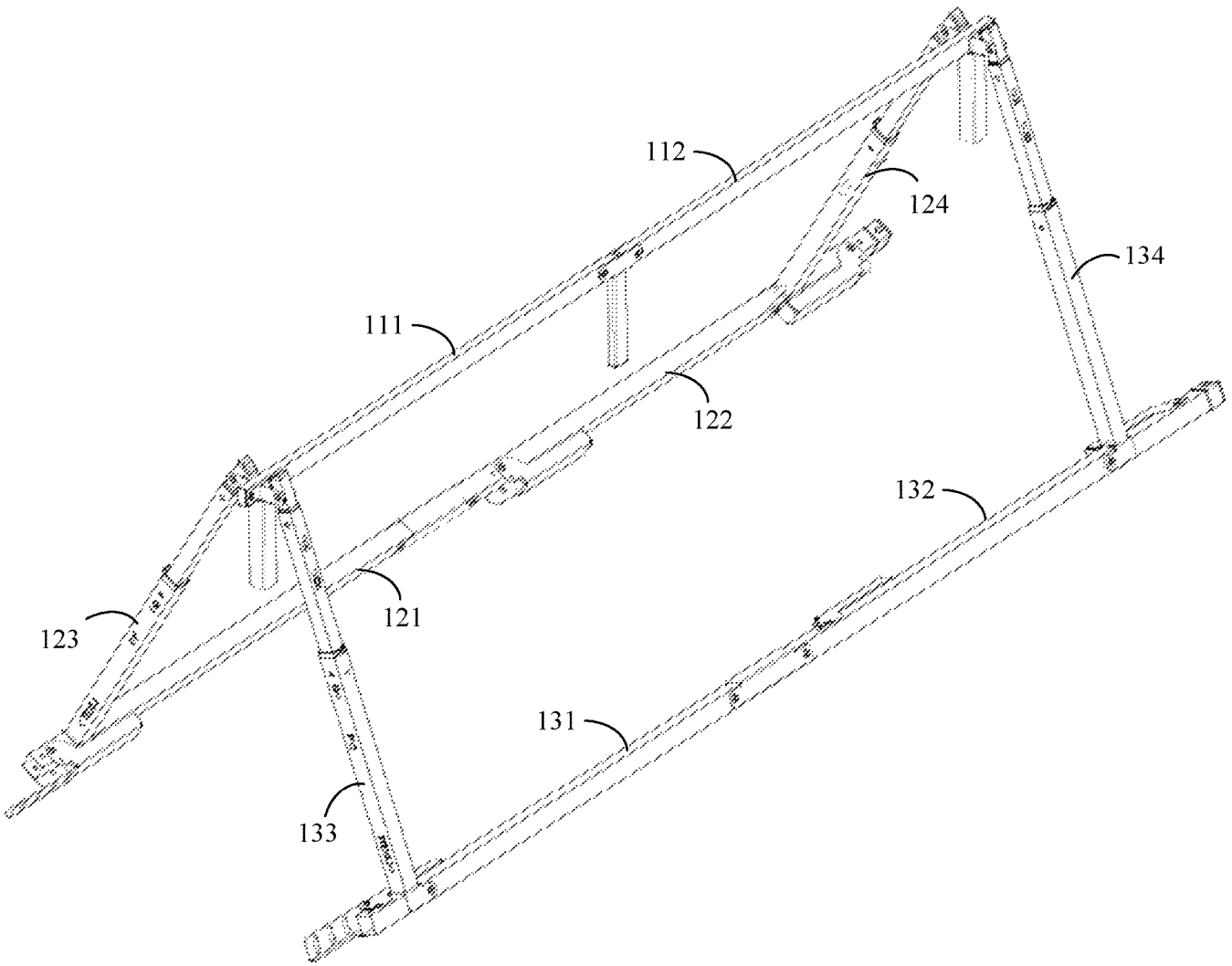
FIG. 5 is a perspective view schematically illustrating the frame of FIG. 1A in a first intermediate state in accordance with some exemplary embodiments of the present disclosure.

When the frame is unfolded, the first, second, third, fourth, fifth, sixth, seventh and eighth auxiliary axes are substantially vertical, e.g., substantially parallel to the z-direction in FIG. 1. When the first and second units are folded onto each other, for instance by rotating the first unit around the first longitudinal axis and rotating the second unit around the second longitudinal axis as illustrated in FIG. 5, the first, second, third, fourth, fifth, sixth, seventh and eighth auxiliary axes are substantially parallel to the first, second, third and fourth lateral axes as illustrated in FIG. 6.

Figure 6:
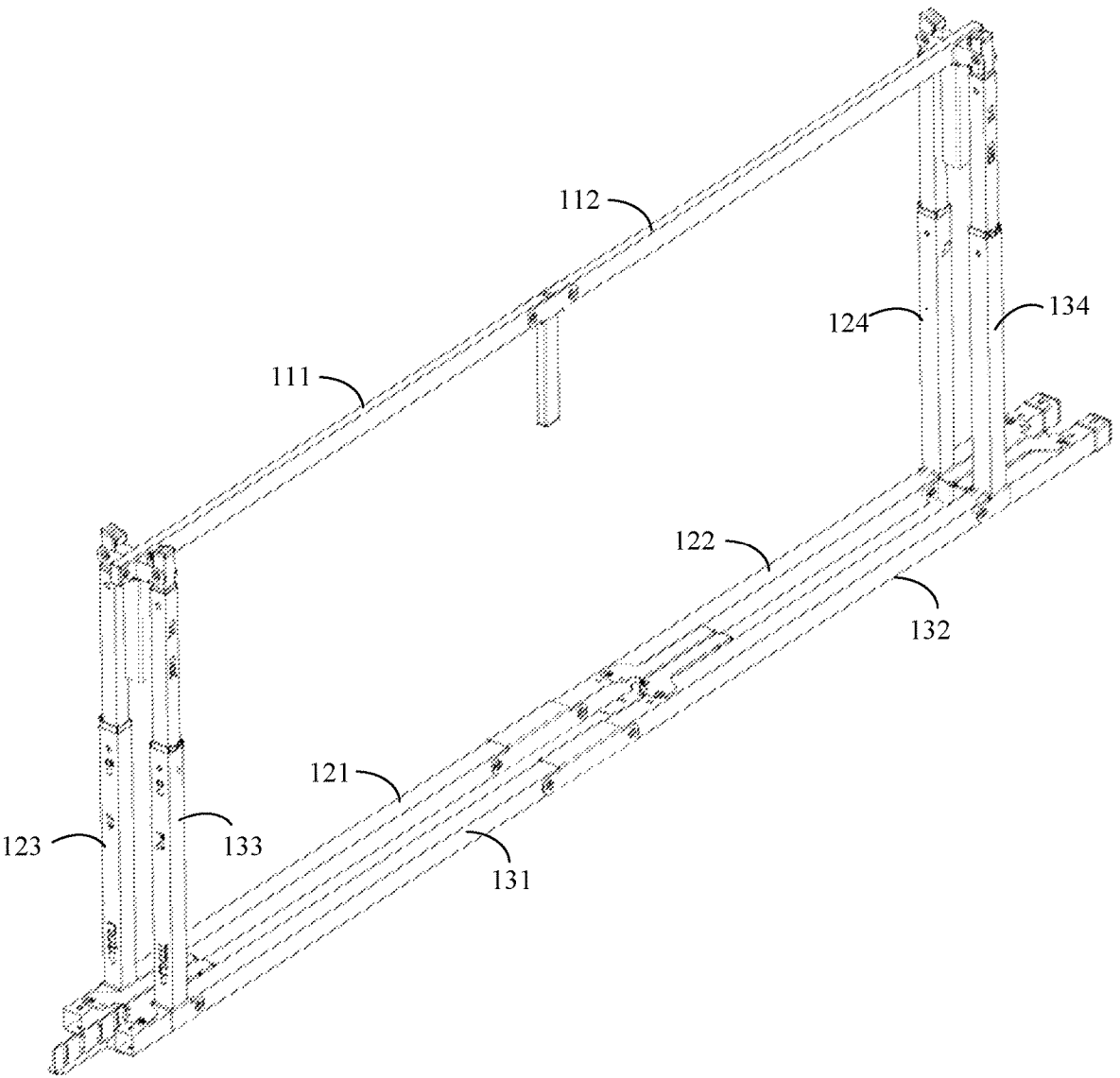
FIG. 6 is a perspective view schematically illustrating the frame of FIG. 1A in a second intermediate state in accordance with some exemplary embodiments of the present disclosure.

In some exemplary embodiments, when the first and second units are folded onto each other as illustrated in FIG. 6, the first and fifth auxiliary axes are aligned with each other. The second and sixth auxiliary axes are aligned with each other. The third and seventh auxiliary axes are aligned with each other. The fourth and eighth auxiliary axes are aligned with each other. In some exemplary embodiments, a distance between the first and second auxiliary axes or between the fifth and sixth auxiliary axes is greater than a distance between the third and fourth lateral axes. This allows the first and second supporting members of the middle unit, the first and second lateral members of the first unit, and the third and fourth lateral members of the second unit to be folded and sandwiched in between the first and second longitudinal members of the first unit and the third and fourth longitudinal members of the second unit. As a result, the folded frame is very compact and requires less storage space.

Figure 1B:
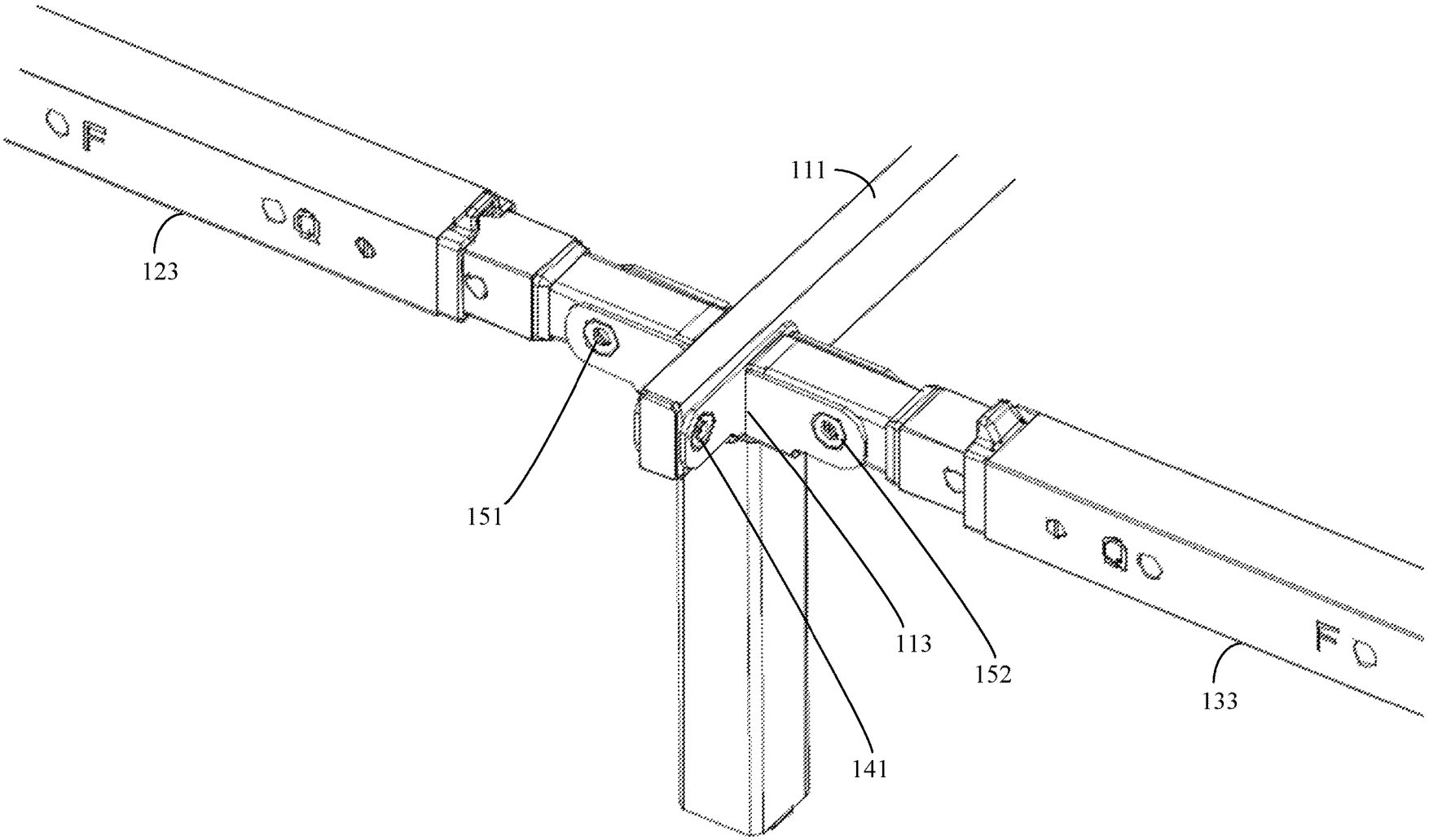
FIG. 1B is a partially enlarged view of FIG. 1A.
Figure 1C:
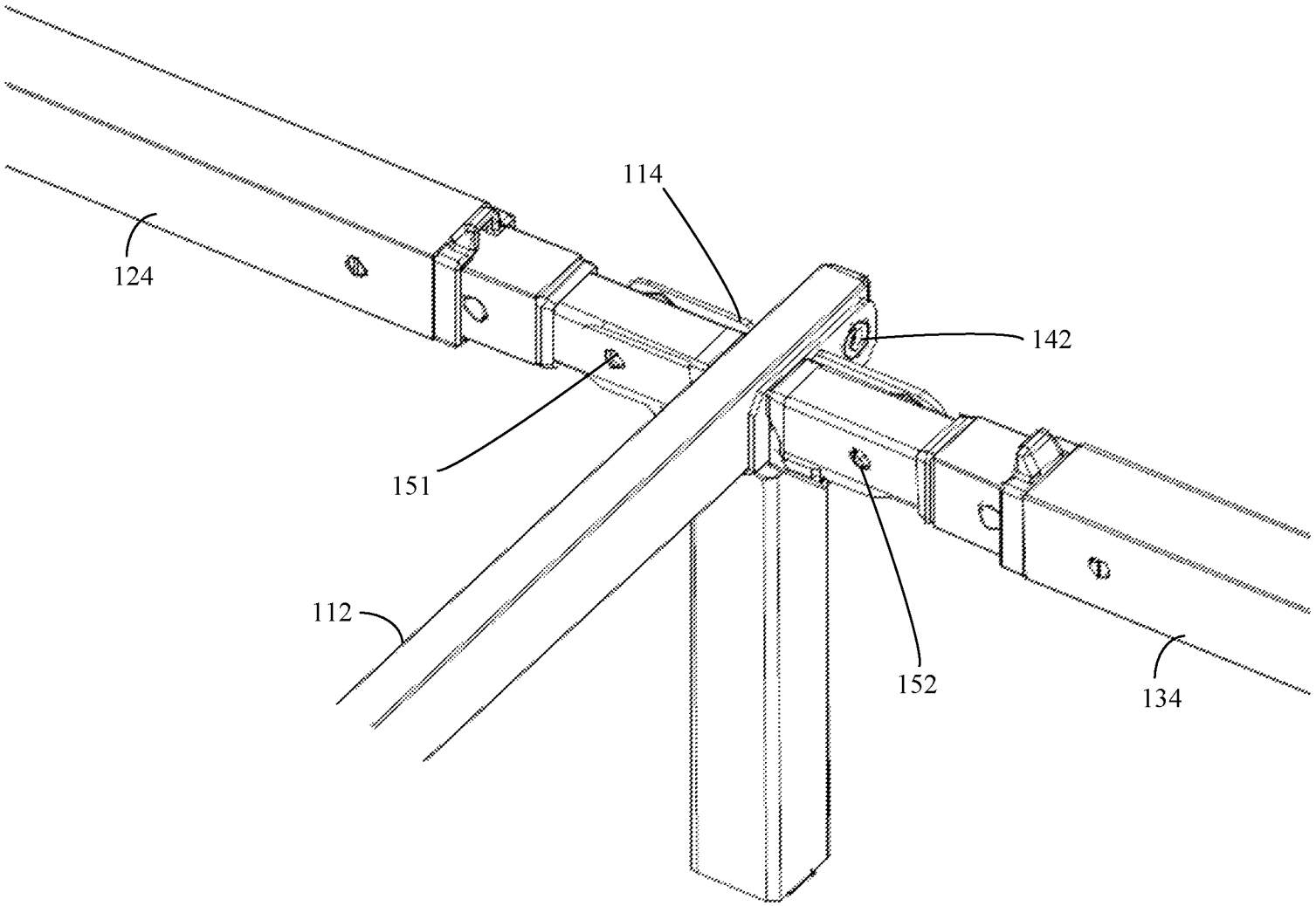
FIG. 1C is another partially enlarged view of FIG. 1A.
Figure 7A:
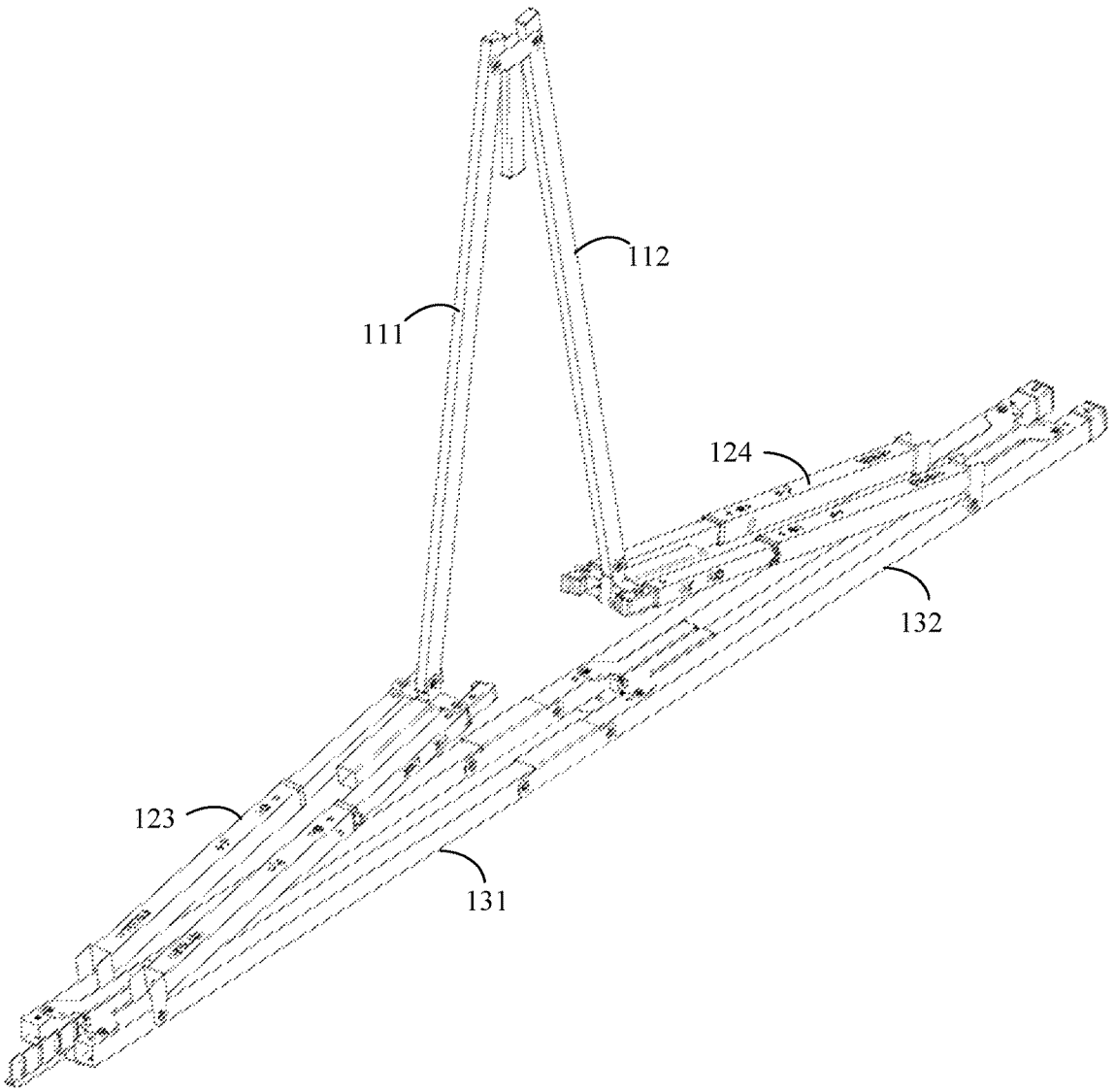
FIG. 7A is a perspective view schematically illustrating the frame of FIG. 1A in a third intermediate state in accordance with some exemplary embodiments of the present disclosure.
Figure 7B:
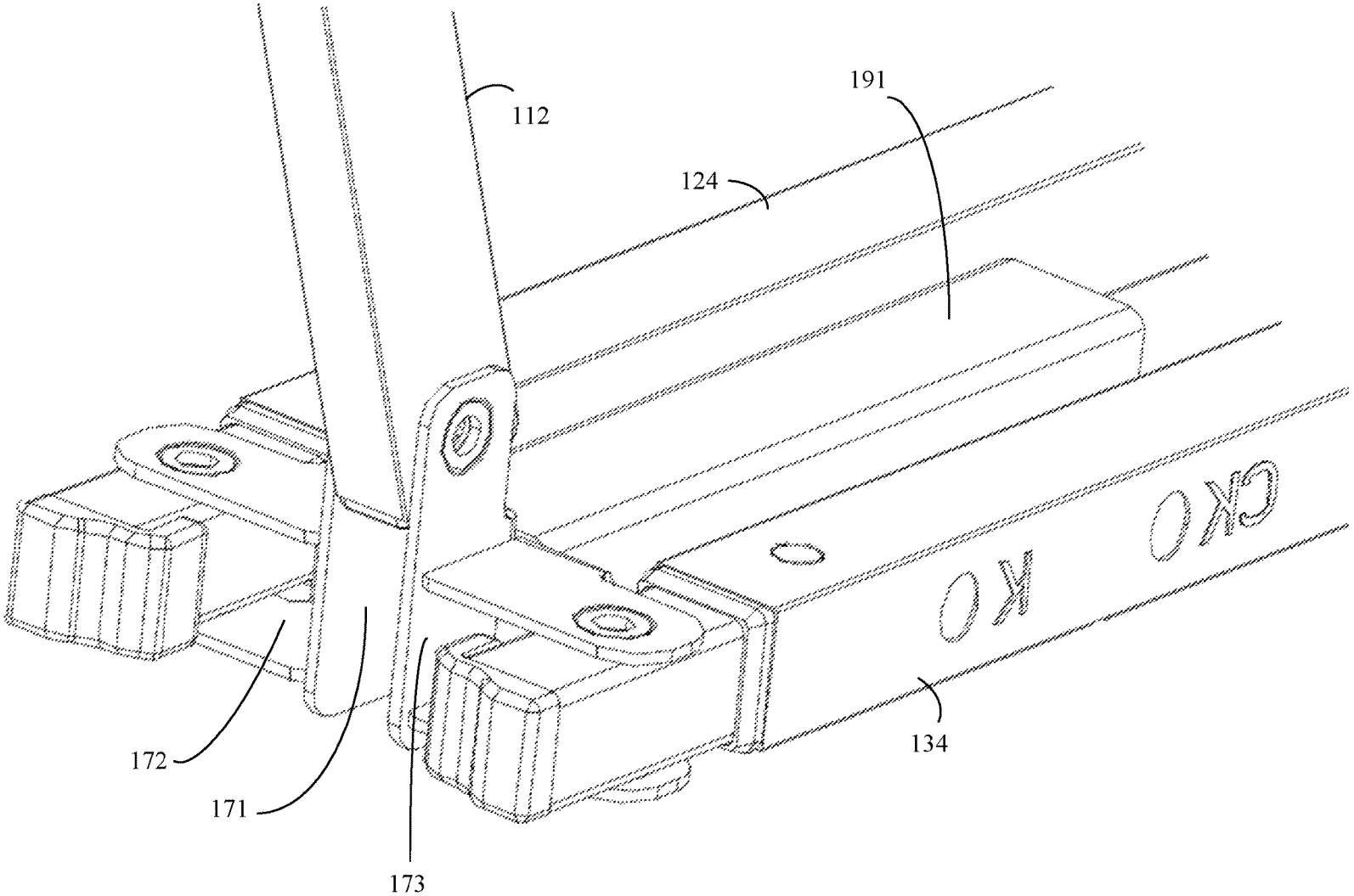
FIG. 7B is a partially enlarged view of FIG. 7A.

Referring in particular to FIGS. 1B, 1C and 7B, in some exemplary embodiments, first coupler 113 or second coupler 114 includes a plurality of slots to pivotally connect and/or receive the distal end of the first or second supporting member of the middle unit, the distal end of the first or second lateral member of the first unit, and the distal end of the third or fourth lateral member of the second unit. For instance, in some exemplary embodiments, the first or second coupler includes first slot 171, second slot 172 and third slot 173. The first slot pivotally connects the distal end of the first or second supporting member of the middle unit and when the frame is unfolded, receives the distal end of the first or second supporting member of the middle unit. The second slot pivotally connects the distal end of the first or second lateral member of the first unit and when the frame is unfolded, receives the distal end of the first or second lateral member of the first unit. The third slot pivotally connects the distal end of the third or fourth lateral member of the second unit and when the frame is unfolded, receives the distal end of the third or fourth lateral member of the second unit.

In some exemplary embodiments, the second and third slots are aligned with each other, e.g., aligned with each other in the lateral direction when the frame is unfolded. The first slot is substantially perpendicular to the second and third slots, e.g., in the longitudinal direction when the frame is unfolded. The first slot is generally positioned between the second and third slots.

In some exemplary embodiments, first coupler 113 is configured so that first lateral axis 141 is located outwardly relative to first lateral member 123 of the first unit and third lateral member 133 of the second unit. Similarly, in some embodiments, second coupler 114 is configured such that second lateral axis 142 is located outwardly relative to second lateral member 124 of the first unit and fourth lateral member 134 of the second unit.

In some exemplary embodiments, each of the middle unit, first unit and second unit includes a plurality of legs. For instance, referring in particular to FIG. 2, in some exemplary embodiments, middle unit 110 includes a plurality of legs 191, with one fixedly connected to the first coupler, one fixedly connected to the second coupler, and one fixedly connected to the third coupler. In some exemplary embodiments, first unit 120 includes a first plurality of legs 192, each pivotally connected to the first or second longitudinal member. Similarly, second unit 130 includes a second plurality of legs 193, each pivotally connected to the third or fourth longitudinal member.

Figure 9:
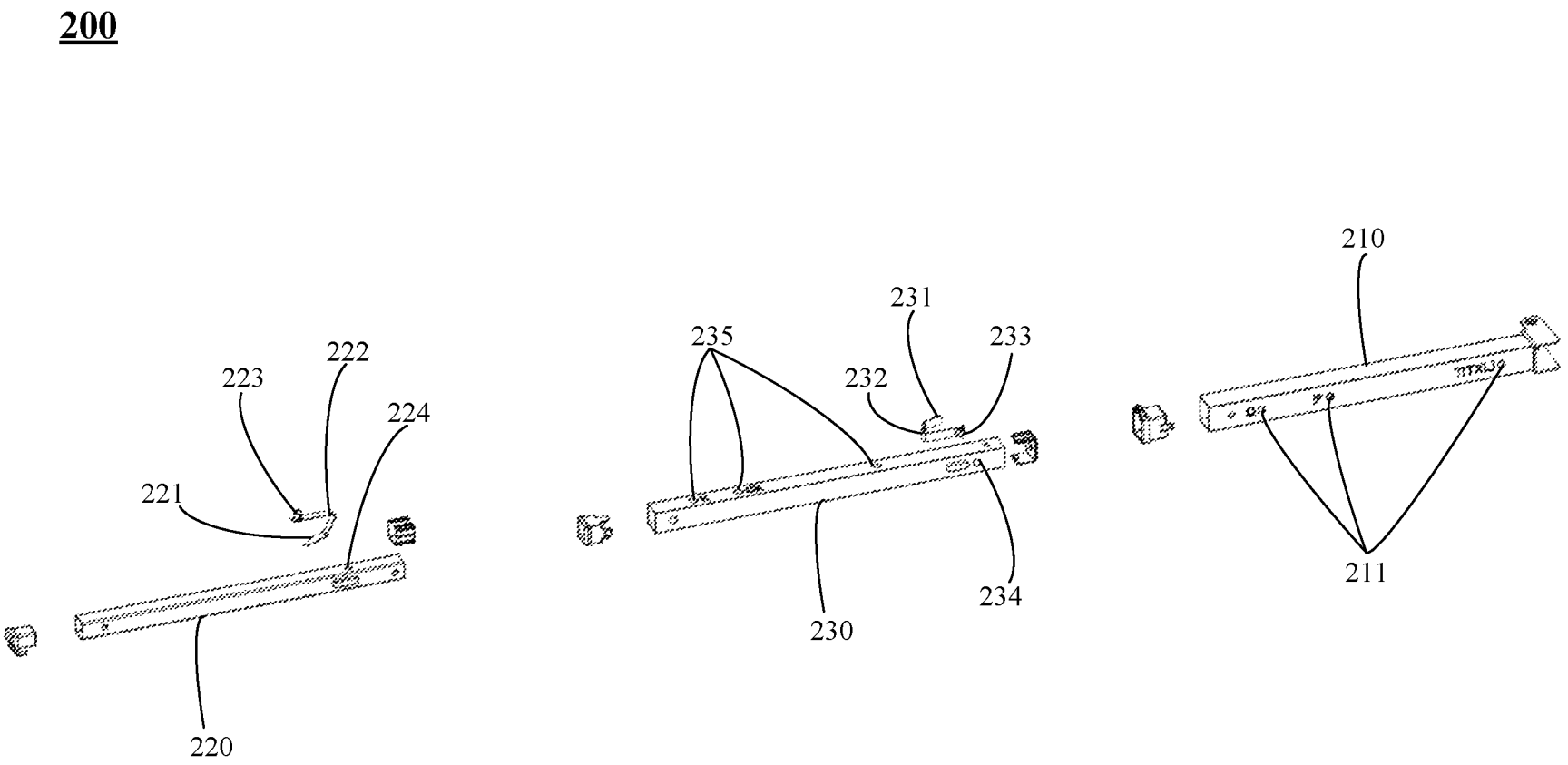
FIG. 9 is an exploded view schematically illustrating an exemplary support of the frame of FIG. 1A in accordance with some exemplary embodiments of the present disclosure.

Referring to FIG. 9, there is depicted an exemplary lateral support 200 in accordance with some exemplary embodiments of the present disclosure. Lateral support 200 can be used for any one of first lateral member 123, second lateral member 124, third lateral member 133 and fourth lateral member 134.

Lateral support 200 generally includes a plurality of lateral segments telescopically coupled with each other. The lateral support can include any suitable number of lateral segments, including but not limited to two, three, four, five or more than five lateral segments. For instance, in some exemplary embodiments, lateral support 200 includes first lateral segment 210 and second lateral segment 220. The first and second lateral segments are coupled with each other and selectively movable relative to each other along a length direction of the lateral support. In some exemplary embodiments, lateral support 200 includes third lateral segment 230 disposed between the first and second lateral segments. In some such embodiments, the third lateral segment is slidably coupled with the first lateral segment and the second lateral segment is slidably coupled with the third lateral segment such that the first, second and third lateral segments are selectively movable relative to each other along the length direction of the lateral support.

In some exemplary embodiments, at least a portion of each of the first, second and third lateral segments is tubular so that the first lateral segment receives at least a portion of the third lateral segment and the third lateral segment receives at least a portion of the second lateral segment. In addition, the first lateral segment includes a plurality of first snap-in holes 211 spaced apart from each other along a length direction of the first lateral segment. The first lateral segment can include any suitable number of first snap-in holes, including but not limited to two, three, four, five or more than five first snap-in holes. The third lateral segment includes first snapping part 231 selectively engageable with any one of the plurality of first snap-in holes 211 of the first lateral segment. Engagement of the first snapping part with any first snap-in hole restricts the relative movement of the first and third lateral segments and thus defines a corresponding length of the lateral support.

In some exemplary embodiments, first snapping part 231 of the third lateral segment includes first elastic member 232 and first protrusion 233 coupled or formed with the first elastic member. The first elastic member is disposed inside of the third lateral segment and the first protrusion is biased by the first elastic member to protrude through hole 234 on a wall of the third lateral segment and engage with any first snap-in hole of the first lateral segment when it is aligned with the first protrusion.

In some exemplary embodiments, third lateral segment 230 also includes a plurality of second snap-in holes 235 spaced apart from each other along a length direction of the third lateral segment. The third lateral segment can include any suitable number of second snap-in holes, including but not limited to two, three, four, five or more than five second snap-in holes. In addition, second snap-in holes 235 can be formed on the same side wall or different side walls of third lateral segment 230 as hole 234. The second lateral segment includes a second snapping part 221 selectively engageable with any one of the plurality of second snap-in holes 235 of the third lateral segment. Engagement of the second snapping part with any second snap-in hole restricts the relative movement of the second and third lateral segments and thus defines a corresponding length of the lateral support.

In some exemplary embodiments, second snapping part 221 of the second lateral segment includes second elastic member 222 and second protrusion 223 coupled or formed with the second elastic member. The second elastic member is disposed inside of the second lateral segment and the second protrusion is biased by the second elastic member to protrude through hole 224 on a wall of the second lateral segment and engage with any second snap-in hole of the third lateral segment when it is aligned with the second protrusion.

Figure 2:
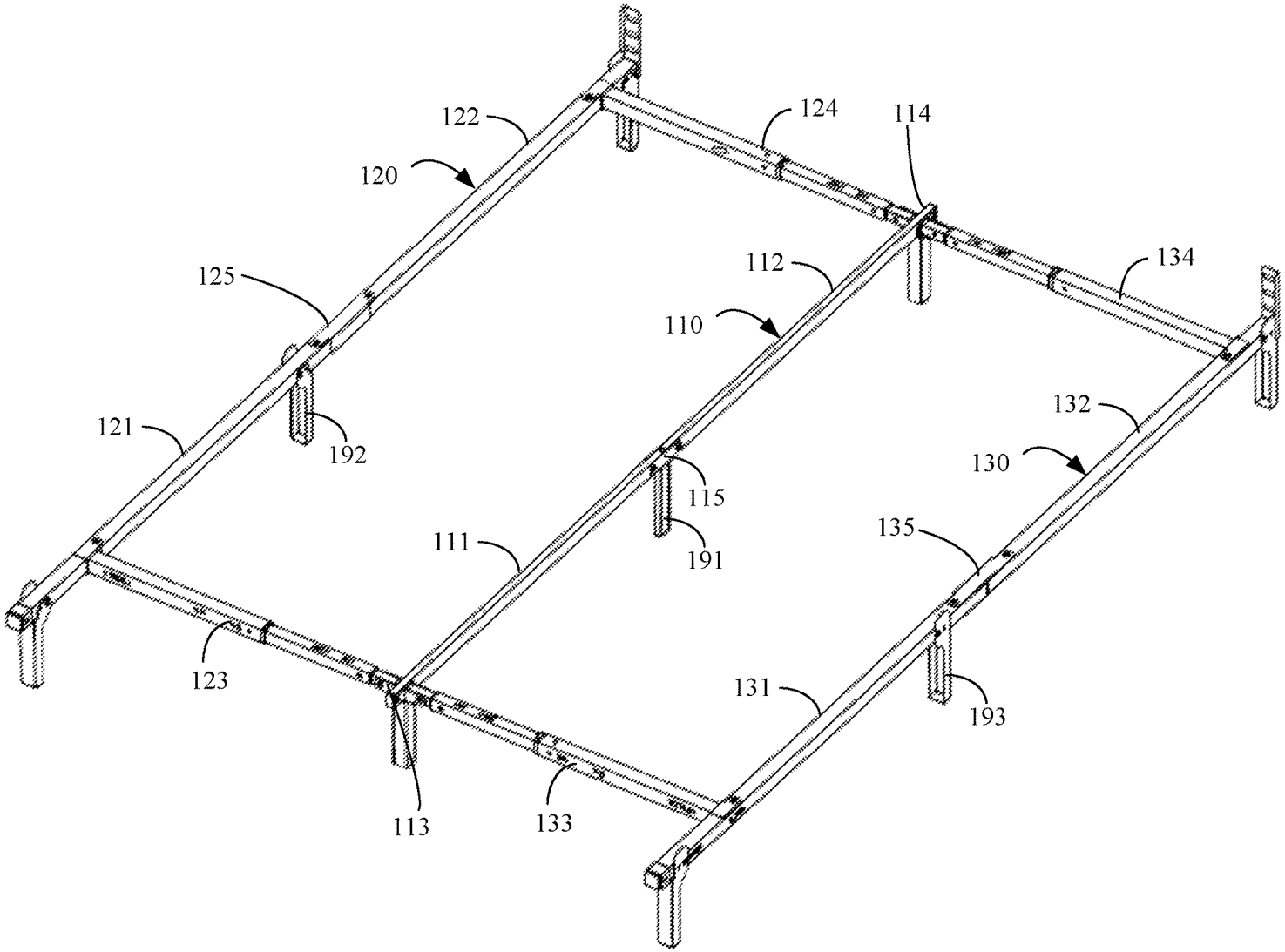
FIG. 2 is a top perspective view schematically illustrating the frame of FIG. 1A in the unfolded state and a second size in accordance with some exemplary embodiments of the present disclosure.
Figure 3:
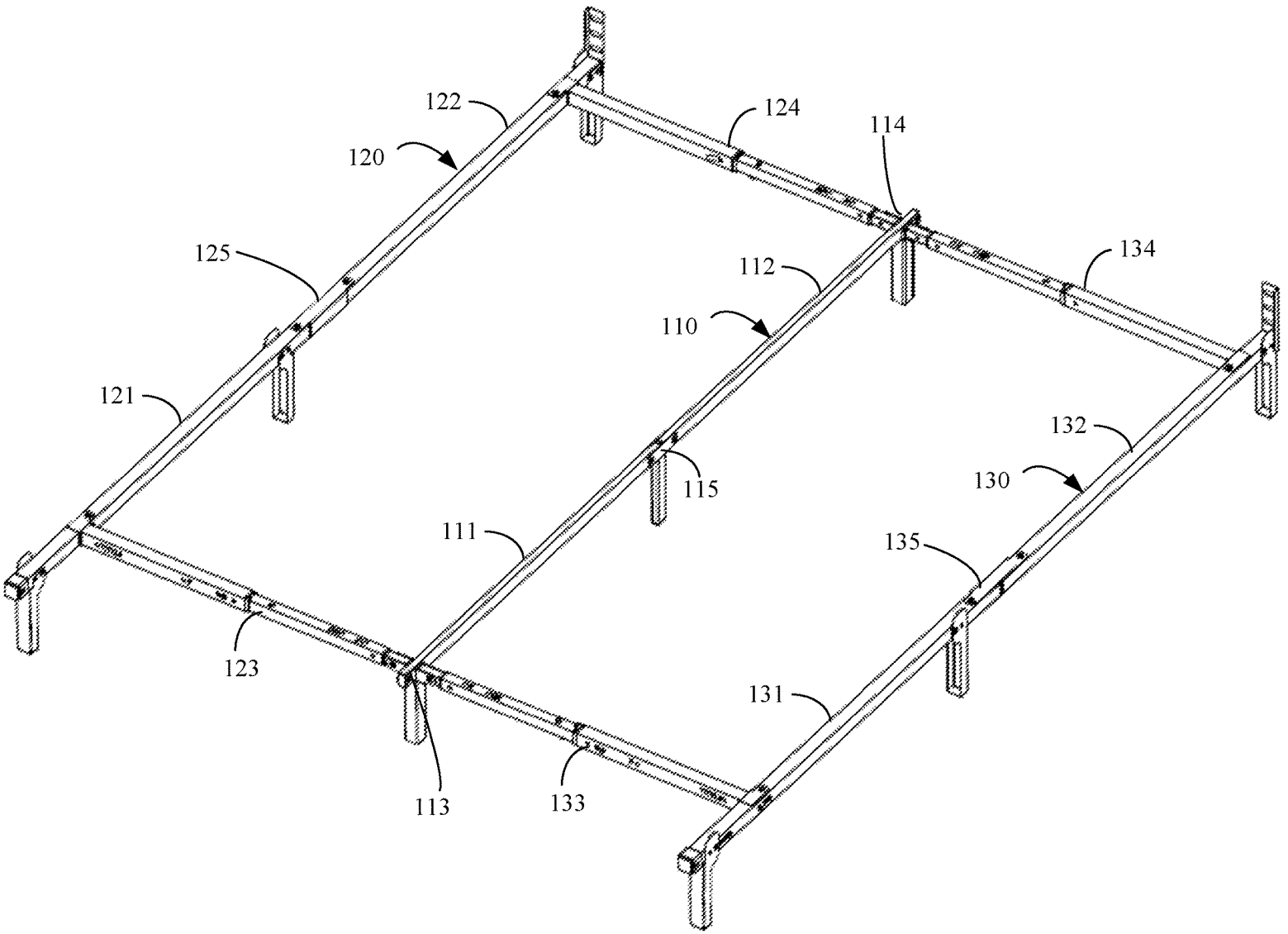
FIG. 3 is a top perspective view schematically illustrating the frame of FIG. 1A in the unfolded state and a third size in accordance with some exemplary embodiments of the present disclosure.
Figure 4A:
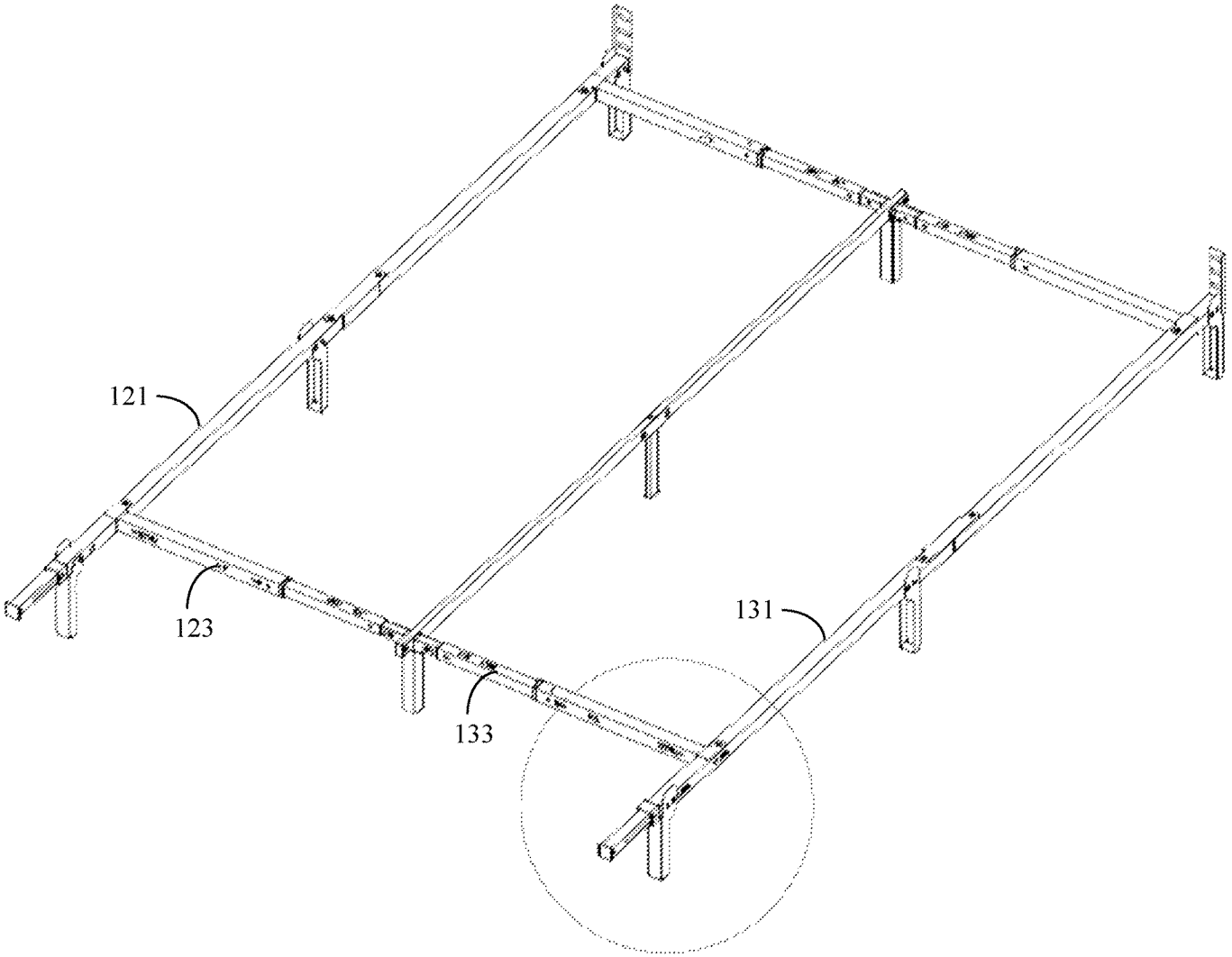
FIG. 4A is a top perspective view schematically illustrating the frame of FIG. 1A in the unfolded state and a fourth size in accordance with some exemplary embodiments of the present disclosure.
Figure 4B:
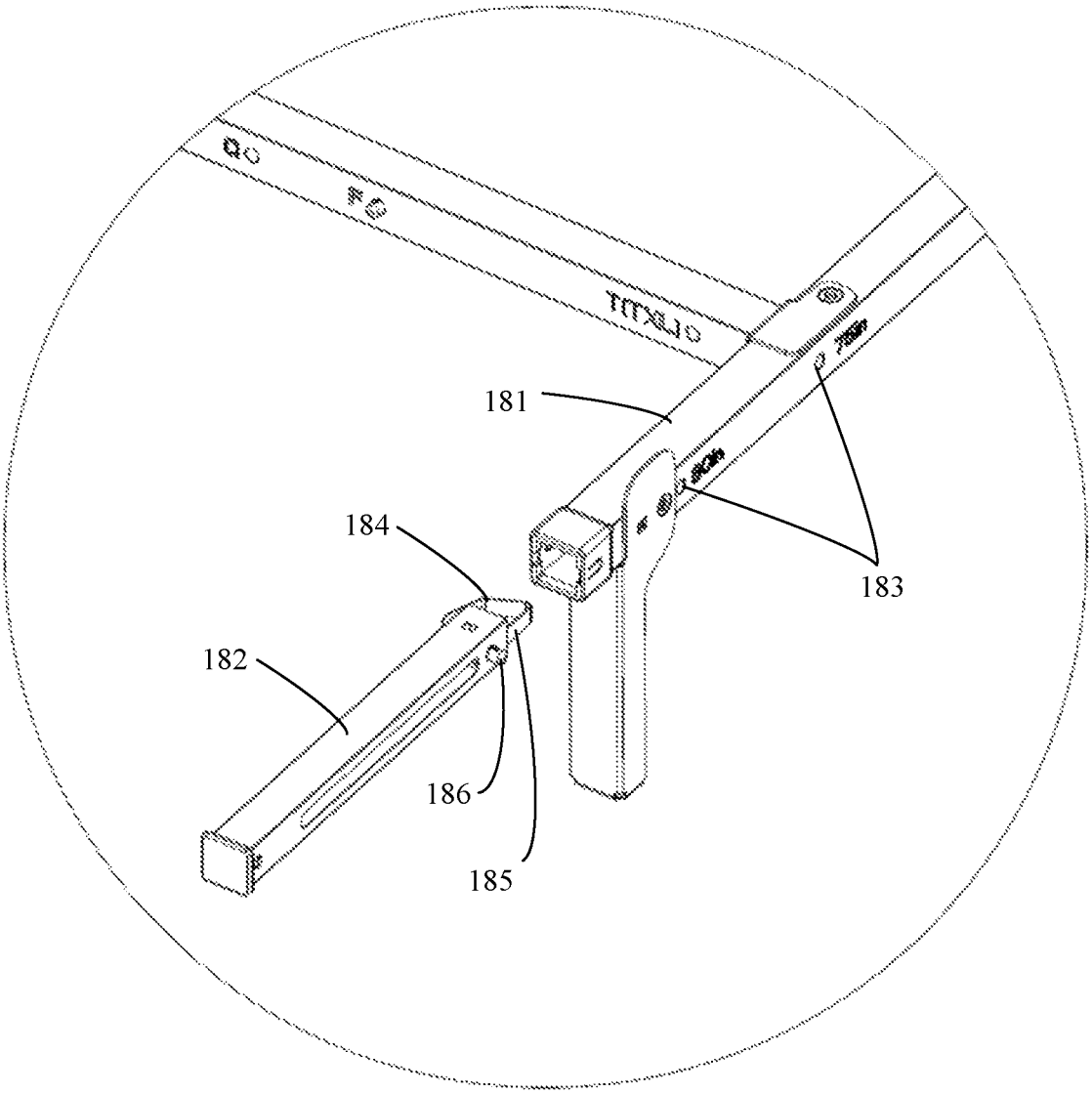
FIG. 4B is an enlarged view taken along circle A in FIG. 4A.

In some exemplary embodiments, lateral support 200 is used as each of the first and second lateral members of the first unit. In some exemplary embodiments, additionally, optionally or alternatively, lateral support 200 is used as each of the third and fourth lateral members of the second unit. In cases where the lateral support is used as first lateral member 123, the first lateral segment is pivotally connected to first longitudinal member 121 of the first unit and the second lateral segment is pivotally connected to first coupler 113. In cases where the lateral support is used as second lateral member 124, the first lateral segment is pivotally connected to second longitudinal member 122 of the first unit and the second lateral segment is pivotally connected to second coupler 114. In cases where the lateral support is used as third lateral member 133, the first lateral segment is pivotally connected to third longitudinal member 131 of the second unit and the second lateral segment is pivotally connected to first coupler 113. In cases where the lateral support is used as fourth lateral member 134, the first lateral segment is pivotally connected to fourth longitudinal member 132 of the second unit and the second lateral segment is pivotally connected to second coupler 114. As such, when unfolded, the dimension of the frame in the lateral direction can adjusted by adjusting the lengths of the lateral supports as illustrated in FIGS. 1A, 2 and 3.

Referring back to FIGS. 4A and 4B, in some exemplary embodiments, each of first longitudinal member 121 of the first unit and third longitudinal member 131 of the second unit is adjustable in length. This allows the frame, when unfolded, to adjust its size in the longitudinal direction of the frame. For instance, in some exemplary embodiments, each of first longitudinal member 121 of the first unit and third longitudinal member 131 of the second unit includes first longitudinal segment 181 and second longitudinal segment 182 telescopically connected to each other and selectively movable relative to each other. In some exemplary embodiments, at least a portion of each of the first and second longitudinal segments is tubular with the first longitudinal segment receiving at least a portion of the second longitudinal segment. In some exemplary embodiments, the first longitudinal segment includes a plurality of third snap-in holes 183 spaced apart from each other along a length direction of the first longitudinal segment. The first longitudinal segment can include any suitable number of third snap-in holes, including but not limited to two, three, four, five or more than five third snap-in holes. The second longitudinal segment includes third snapping part 184 selectively engageable with any of the one or more third snap-in holes 183 of the first longitudinal segment. As such, the frame is allowed to adjust its size in the longitudinal direction when unfolded.

In some exemplary embodiments, third snapping part 184 includes third elastic member 185 and third protrusion 186 coupled or formed with the third elastic member. The third elastic member is disposed inside of the first or second longitudinal segment and the third protrusion is biased by the third elastic member to protrude through a hole on a wall of the second longitudinal segment and engage with any third snap-in hole of the first longitudinal segment when it is aligned with the third protrusion.

Figure 8:
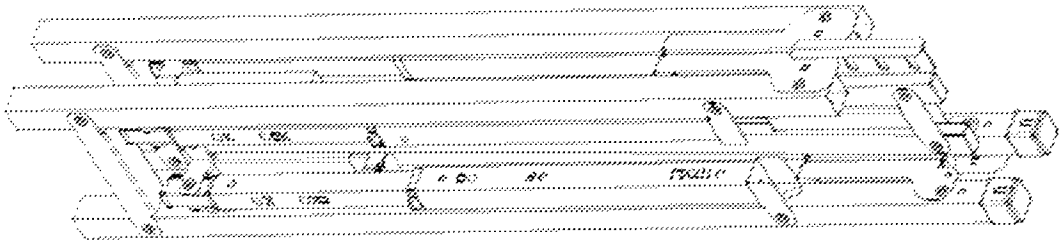
FIG. 8 is a perspective view schematically illustrating the frame of FIG. 1A in a folded state in accordance with some exemplary embodiments of the present disclosure.

Frame 100 is foldable, adjustable in size and easy to use. The frame can be folded and unfolded as a whole with no need to assemble or dissemble any parts. For instance, to fold the frame, one can rotate first unit 120 and second unit 130 toward each other as illustrated in FIG. 5. Once the first and second units are folded onto each other as illustrated in FIG. 6, one can rotate first lateral member 123 of the first unit and third lateral member 133 of the second unit toward first longitudinal member 121 of the first unit and third longitudinal member 131 of the second unit, and rotate second lateral member 124 of the first unit and fourth lateral member 134 of the second toward second longitudinal member 122 of the first unit and fourth longitudinal member 132 of the second unit as illustrated in FIG. 7. After that, one can rotate the first lateral and longitudinal members of the first unit and the third lateral and longitudinal members of the second unit toward first supporting member 111 of the middle unit, and rotate the second lateral and longitudinal members of the first unit and the fourth lateral and longitudinal members of the second unit toward second supporting member 112 of the middle unit until all the members of the middle, first and second units are folded onto each other as illustrated in FIG. 8. The resulting folded frame is compact, easy to transport and requires less storage space.

Reversing the process will unfold the frame. When unfolded, the frame can be adjusted to different sizes by expanding or contracting (i) first lateral member 123 and second lateral member 124 of the first unit, (ii) third lateral member 133 and fourth lateral member 134 of the second unit, (iii) first longitudinal member 121 of the first unit and third longitudinal member 131 of the second unit, or any combination thereof. The frame can be adjusted to a variety of sizes, including but not limited to a twin size, a full size, a queen size, a king size or a California king size, to meet different needs or preferences of different users.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "top" or "bottom", "lower" or "upper", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first bar could be termed a second bar, and, similarly, a second bar could be termed a first bar, without changing the meaning of the description, so long as all occurrences of the "first bar" are renamed consistently and all occurrences of the "second bar" are renamed consistently.

What is claimed is:

1. A frame, including:

a middle unit including a first supporting member, a second supporting member, a first coupler and a second coupler, wherein proximal ends of the first and second supporting members are pivotally connected to each other;

a distal end of the first supporting member is pivotally connected to the first coupler such that the first supporting member is rotatable relative to the first coupler around a first lateral axis; and a distal end of the second supporting member is pivotally connected to the second coupler such that the second supporting member is rotatable relative to the second coupler around a second lateral axis;

a first unit disposed at a first side of the middle unit when the frame is unfolded, the first unit including a first leg, a first longitudinal member, a second longitudinal member, a first lateral member and a second lateral member, wherein:

proximal ends of the first and second longitudinal members are pivotally connected to each other;

a distal end of the first lateral member is pivotally connected to the first longitudinal member;

a distal end of the second lateral member is pivotally connected to the second longitudinal member; and a proximal end of the first lateral member is pivotally connected to the first coupler and a proximal end of the second lateral member is pivotally connected to the second coupler such that the first unit is rotatable relative to the first and second couplers around a first longitudinal axis; and a second unit disposed at a second side of the middle unit when the frame is unfolded, the second unit including a second leg, a third longitudinal member, a fourth longitudinal member, a third lateral member and a fourth lateral member, wherein:

proximal ends of the third and fourth longitudinal members are pivotally connected to each other;

a distal end of the third lateral member is pivotally connected to the third longitudinal member;

a distal end of the fourth lateral member is pivotally connected to the fourth longitudinal member; and a proximal end of the third lateral member is pivotally connected to the first coupler and a proximal end of the fourth lateral member is pivotally connected to the second coupler such that the second unit is rotatable relative to the first and second couplers around a second longitudinal axis; wherein:

(i) the first and second supporting members of the middle unit, the first and second longitudinal members of the first unit, the first and second lateral members of the first unit, the third and fourth longitudinal members of the second unit, and the third and fourth lateral members of the second unit are foldable onto each other, (ii) each of the first and second lateral members of the first unit is adjustable in length, thereby allowing the frame when unfolded to adjust its size in a lateral direction of the frame, (iii) each of the first longitudinal member of the first unit and the third longitudinal member of the second unit comprises a proximal longitudinal segment and a distal longitudinal segment telescopically connected to each other and selectively movable relative to each other in a longitudinal direction of the frame, the proximal longitudinal segment of the first longitudinal member is fixedly coupled to the first leg, and the proximal longitudinal segment of the third longitudinal member is fixedly coupled to the second leg, and (iv) the distal end of the first lateral member is pivotally connected to the proximal longitudinal segment of the first longitudinal member and remains stationary relative to the distal longitudinal segment of the first longitudinal member during selective movement of the distal longitudinal segment of the first longitudinal member, such that the selective movement of the distal longitudinal segment of the first longitudinal member is independent of the first lateral member and independent of the first leg, and the distal end of the third lateral member is pivotally connected to the proximal longitudinal segment of the third longitudinal member and remains stationary relative to the distal longitudinal segment of the third longitudinal member during selective movement of the distal longitudinal segment of the third longitudinal member, such that the selective movement of the distal longitudinal segment of the third longitudinal member is independent of the third lateral member and independent of the second leg, thereby allowing the frame to adjust its size in the longitudinal direction of the frame by moving only the distal longitudinal segment segments of the first longitudinal member and the third longitudinal member.

2. The frame of claim 1, wherein each of the first and second couplers includes:

a first slot to receive or pivotally connect the distal end of the first or second supporting member of the middle unit;

a second slot to receive or pivotally connect the distal end of the first or second lateral member of the first unit; and a third slot to receive or pivotally connect the distal end of the third or fourth lateral member of the second unit.

3. The frame of claim 2, wherein:

the second and third slots are aligned with each other; and the first slot is substantially perpendicular to the second and third slots.

4. The frame of claim 1, wherein:

the first lateral axis is located outwardly relative to the first lateral member of the first unit and the third lateral member of the second unit; and the second lateral axis is located outwardly relative to the second lateral member of the first unit and the fourth lateral member of the second unit.

5. The frame of claim 1, wherein the first and second units are substantially the same.

6. The frame of claim 1, wherein each of the third and fourth lateral members of the second unit is adjustable in length.

7. The frame of claim 1, wherein each of the first and second lateral members of the first unit includes a plurality of segments telescopically coupled with each other.

8. The frame of claim 7, wherein the plurality of segments includes:

a first segment pivotally connected to the first or second longitudinal member of the first unit; and a second segment pivotally connected to the first or second coupler, wherein the first and second segments are coupled with each other and movable relative to each other along a length direction of the first or second lateral member of the first unit.

9. The frame of claim 8, wherein the plurality of segments further includes:

a third segment disposed between the first and second segments, wherein (i) the third segment is slidably coupled with the first segment, (ii) the second segment is slidably coupled with the third segment, and (iii) the first, second and third segments are movable relative to each other along the length direction of the first or second lateral member of the first unit.

10. The frame of claim 9, wherein:

at least a portion of each of the first, second and third segments is tubular;

the first segment receives at least a portion of the third segment;

the third segment receives at least a portion of the second segment;

the first segment includes a plurality of first snap-in holes spaced apart from each other along a length direction of the first segment;

the third segment includes a first snapping part and a plurality of second snap-in holes spaced apart from each other along a length direction of the third segment;

the second segment includes a second snapping part; and the first snapping part of the third segment is selectively engageable with any one of the plurality of first snap-in holes of the first segment, and the second snapping part of the second segment is selectively engageable with any one of the plurality of second snap-in holes of the third segment, thereby allowing the frame when unfolded to adjust its size.

11. The frame of claim 10, wherein:

the first snapping part includes a first elastic member disposed inside of the third segment and a first protrusion biased by the first elastic member to protrude through a hole on a wall of the third segment; and the second snapping part includes a second elastic member disposed inside of the second segment and a second protrusion biased by the second elastic member to protrude through a hole on a wall of the second segment.

12. The frame of claim 1, wherein:

the proximal ends of the first and second supporting members of the middle unit are pivotally connected to each other by a third coupler such that the first supporting member is rotatable relative to the third coupler around a third lateral axis, and the second supporting member is rotatable relative to the third coupler around a fourth lateral axis.

13. The frame of claim 12, wherein:

the proximal ends of the first and second longitudinal members are pivotally connected to each other by a fourth coupler such that the first longitudinal member is rotatable relative to the fourth coupler around a first auxiliary axis, and the second longitudinal member is rotatable relative to the fourth coupler around a second auxiliary axis;

the distal end of the first lateral member is pivotally connected to the first longitudinal member such that the first longitudinal member is rotatable relative to the first lateral member around a third auxiliary axis;

the distal end of the second lateral member is pivotally connected to the second longitudinal member such that the second longitudinal member is rotatable relative to the second lateral member around a fourth auxiliary axis;

the proximal ends of the third and fourth longitudinal members are pivotally connected to each other by a fifth coupler such that the third longitudinal member is rotatable relative to the fifth coupler around a fifth auxiliary axis, and the fourth longitudinal member is rotatable relative to the fifth coupler around a sixth auxiliary axis;

the distal end of the third lateral member is pivotally connected to the third longitudinal member such that the third longitudinal member is rotatable relative to the third lateral member around a seventh auxiliary axis;

the distal end of the fourth lateral member is pivotally connected to the fourth longitudinal member such that the fourth longitudinal member is rotatable relative to the fourth lateral member around an eighth auxiliary axis; and when the frame is unfolded, the first, second, third, fourth, fifth, sixth, seventh and eighth auxiliary axes are substantially vertical.

14. The frame of claim 13, wherein:

when the first and second units are folded onto each other by rotating the first unit around the first longitudinal axis and rotating the second unit around the second longitudinal axis, the first, second, third, fourth, fifth, sixth, seventh and eighth auxiliary axes are substantially parallel to the first, second, third and fourth lateral axes.

15. The frame of claim 14, wherein when the first and second units are folded onto each other by rotating the first unit around the first longitudinal axis and rotating the second unit around the second longitudinal axis:

the first and fifth auxiliary axes are aligned with each other;

the second and sixth auxiliary axes are aligned with each other;

the third and seventh auxiliary axes are aligned with each other; and the fourth and eighth auxiliary axes are aligned with each other.

16. The frame of claim 13, wherein a distance between the first and second auxiliary axes or between the fifth and sixth auxiliary axes is greater than a distance between the third and fourth lateral axes.

17. The frame of claim 12, wherein the middle unit further includes:

a first middle leg fixedly connected to the first coupler;

a second middle leg fixedly connected to the second coupler; and a third middle leg fixedly connected to the third coupler.

18. The frame of claim 1, wherein the first unit further includes a first plurality of legs, each pivotally connected to the first or second longitudinal member; and the second unit further includes a second plurality of legs, each pivotally connected to the third or fourth longitudinal member.

19. A frame, including:

a middle unit;

a first unit disposed at a first side of the middle unit when the frame is unfolded, the first unit including (i) a first longitudinal support, and (ii) a pair of first lateral supports, each having an end connected to the middle unit and another end connected to the first longitudinal support; and a second unit disposed at a second side of the middle unit when the frame is unfolded, the second unit including (i) a second longitudinal support, and (ii) a pair of second lateral supports, each having an end connected to the middle unit and another end connected to the second longitudinal support, wherein:

(i) each of the first longitudinal support of the first unit and the second longitudinal support of the second unit comprises a longitudinal segment selectively movable in a longitudinal direction of the frame, wherein (a) the pair of first lateral supports remains stationary relative to the first longitudinal support of the first unit during selective movement of the first longitudinal support of the first unit, (b) the pair of first lateral supports remains stationary relative to the second longitudinal support of the second unit during selective movement of the second longitudinal support of the second unit, and (c) the selective movement of the longitudinal segment is independent of the pair of first lateral supports and independent of the pair of second lateral supports, thereby allowing the frame to adjust its size in the longitudinal direction of the frame by moving only the longitudinal segment of the first longitudinal support of the first unit and the second longitudinal support of the second unit, (ii) the pair of first lateral supports or the pair of second lateral supports is adjustable in length, thereby allowing the frame to adjust its size in a lateral direction of the frame; and (iii) a first distal end of at least one of the pair of first lateral supports is pivotably connected to a proximal longitudinal segment of the first longitudinal support, and a second distal end of at least one of the pair of second lateral supports is pivotably connected to a proximal longitudinal segment of the second longitudinal support.

20. The frame of claim 19, wherein the first unit includes a plurality of segments telescopically coupled with each other.

* * * * *